US007472757B2

(12) United States Patent
Freyer

(10) Patent No.: US 7,472,757 B2
(45) Date of Patent: Jan. 6, 2009

(54) WELL PACKING

(75) Inventor: Jan Freyer, Hafrsfjord (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/551,143

(22) Filed: Oct. 19, 2006

(65) Prior Publication Data

US 2007/0151723 A1 Jul. 5, 2007

Related U.S. Application Data

(63) Continuation of application No. 10/380,100, filed as application No. PCT/NO01/00275 on Jun. 29, 2001, now Pat. No. 7,143,832.

(30) Foreign Application Priority Data

Sep. 8, 2000 (NO) ..... 20004509

(51) Int. Cl.
*E21B 33/12* (2006.01)

(52) U.S. Cl. ..... 166/387; 166/179; 166/187

(58) Field of Classification Search ..... 166/387, 166/179, 187, 294, 295
See application file for complete search history.

(56) References Cited

U.S. PATENT DOCUMENTS

| | | | | |
|---|---|---|---|---|
| 2,144,026 | A * | 1/1939 | Park | 277/340 |
| 2,849,070 | A | 8/1958 | Maly | |
| 2,945,541 | A | 7/1960 | Maly | |
| 3,099,318 | A | 7/1963 | Miller | |
| 3,385,367 | A | 5/1968 | Kollsman | |
| 3,918,523 | A | 11/1975 | Stuber | |
| 4,137,970 | A | 2/1979 | Laflin | |
| 4,182,677 | A | 1/1980 | Bocard | |
| 4,240,800 | A | 12/1980 | Fischer | |
| 4,558,875 | A | 12/1985 | Yamaji | |
| 4,633,950 | A | 1/1987 | Delhommer | |
| 4,635,726 | A | 1/1987 | Walker | |
| 4,862,967 | A | 9/1989 | Harris | |
| 5,180,704 | A | 1/1993 | Reindl | |
| 5,523,357 | A | 6/1996 | Peterson | |
| 6,834,725 | B2 | 12/2004 | Whanger | |

(Continued)

FOREIGN PATENT DOCUMENTS

| | | |
|---|---|---|
| JP | 04-363499 | 12/1992 |

(Continued)

OTHER PUBLICATIONS

Search Report dated Nov. 13, 2001 for International Application No. PCT/NO01/000275.

(Continued)

*Primary Examiner*—Kenneth Thompson
(74) *Attorney, Agent, or Firm*—Marlin R. Smith

(57) ABSTRACT

Annular packer (2) arranged on the outside of a production tubing (4) said packer comprises a core (12) comprising elastic polymer swelling by absorption of hydrocarbons. The core (12) may be surrounded by an external mantle of rubber (10), which is permeable to hydrocarbons and may be equipped with a reinforcement (11). The core (12) swells by absorption of hydrocarbons and the packer (2) expands thus in order to seal the annular space (5) between the production tubing (4) and the well wall (6).

20 Claims, 2 Drawing Sheets

U.S. PATENT DOCUMENTS

| | | | | |
|---|---|---|---|---|
| 6,848,505 | B2 | 2/2005 | Richard | |
| 7,059,415 | B2 | 6/2006 | Bosma | |
| 7,143,832 | B2 * | 12/2006 | Freyer | 166/387 |
| 2004/0194971 | A1 | 10/2004 | Thomson | |
| 2005/0199401 | A1 * | 9/2005 | Patel et al. | 166/387 |

FOREIGN PATENT DOCUMENTS

| | | |
|---|---|---|
| JP | 09-161686 | 6/1997 |
| JP | 2000-064764 | 2/2000 |

OTHER PUBLICATIONS

Letter from the Opponent dated Jan. 31, 2007 in European application No. EP01958642.9.
Communication of a Notice of Opposition in European application No. 01958642.9.
Kirk-Othmer, Encyclopedia of Chemical Technology, 1993, vol. 6, title page, index page, and p. 70.
The Concise Oxford Dictionary, 7th ed., 1985, title page, and pp. 148, 149, 360, 361, 740 and 741.
Halliburton response dated Jul. 18, 2007 (15 pages).
Letter from Opponent dated Aug. 22, 2007 (11 pages).

* cited by examiner

WELL PACKING

CROSS-REFERENCE TO RELATED APPLICATIONS

The present application is a continuation of U.S. application Ser. No. 10/380,100, filed Jun. 16, 2003 now U.S. Pat. No. 7,143,832, which is a national stage filing under 35 USC 371 of international application no. PCT/NO01/00275, filed Jun. 29, 2001, which claims priority to Norway application serial no. 20004509, filed Sep. 8, 2000. The entire disclosures of these prior applications are incorporated herein by this reference.

FIELD OF THE INVENTION

The present invention relates to a method of the nature as stated in the introduction of claim 1 for sealing of an annular space between a well wall in a production well for hydrocarbons and a production tubing, to a peripheral annular packer of the nature as stated in the claims 2-10, comprising an expandable element mainly consisting of rubber material, and to the expanding annular packer for application in said method

BACKGROUND OF THE INVENTION

Completion of oil wells with sand control screens in open hole is a simple and reliable method by to complete a reservoir section. An oil well normally penetrates formations with varying production features, which, in spite of the fact that the sand control screens are closed on the inside, may cause that undesired well fluid by-passes on the outside of these and flow into the section. Therefore, it may be desired to control or shut off sections, which do not produce desired well fluid. This necessitates sealing the external annulus.

Today such seal is achieved by application of inflatable, open-hole packers (external casing packers), which are pressurised by injecting a fluid, which is confined by means of a valve system. As soon as the packer is pressurised, it is unable to follow movements in the face of the formation. Further it is sensitive to changes in temperature and pressure, and there are often considerable problems to achieve a complete seal. Another disadvantage is that the installation of the packer is expensive since well operations requiring complicated equipment are requisited.

From U.S. Pat. No. 4,137,970 a packer is known with an element which by a chemical swelling process result in expansion of the element upon contact with water present in the well at the moment the packer is introduced to the bore hole. The packer element is employed in mining, where water is to be drained from an aquiferous layer above a clay layer. The sealing consists of an expanding packer element. During such a swelling process the packer element will initially expand fast, before it expands slower. This is impractical in an oil well, since the packer will expand before it is placed in the final operating position in the well. This implies that the packer may be put in the wrong position in the well, if it was to be employed in an application like the present invention and cause that the completion string can not be inserted to its planned final position. Application of a medium swelling in water will cause the element to expand upon contact with all regular applied completion fluids or drilling fluids.

From U.S. Pat. No. 4,633,950 polymer particles are known suspended in a special water based carrier fluid, which by circulation pumping shall be injected into a lost circulation zone. The patent does not relate to a packer element, but to a dispersion which shall trickle into porous/fractured rock. The features of such a dispersion implies that it can not be held in place in order to form a solid plug in the annular space of the well. Further, the particles will upon contact with hydrocarbons expand very rapidly due to the large surface area of the small particles. Only minor impurities of remaining oil in the system will therefore result in an undesired early expansion. Moreover, the particles in such a system will not expand at all if they do not contact hydrocarbons before the well is flowing back. This may lead to the polymer being produced with the produced fluids.

Most rubbers have a larger absorption capacity and faster swelling in an aromatic and/or naphtenic hydrocarbon than in an aliphatic hydrocarbon. Most rubbers also have considerably less swelling in water based fluid than in an oil based fluid.

Generally base-oils used in drilling fluids have a higher portion of aliphatic (80-100%) constituents than produced hydrocarbons, normally having 35-80% aliphatic constituents. This implies that most rubbers will have a larger and faster expansion in produced hydrocarbons than in drilling fluids.

PURPOSE OF THE INVENTION

The purpose of the present invention is to enable completion of reservoir sections by complete annular seal, at the same time as the invention allows variations in operational parameters and geological conditions without changing the functionality of the invention. The packer will expand less while the packer is inserted into the well in a drilling fluid or completing fluid than by exposure to hydrocarbons produced from the formation.

This is achieved by the present method for sealing of an annular space between a well wall in a production well for hydrocarbons and a production tubing with a peripheral annular packer comprising an expandable element mainly consisting of rubber material characterised in that in said element a rubber is used which expands by absorbing hydrocarbons, and that the annular packer is inserted mainly by exposing the expanding element to hydrocarbons included in the product of the well.

Further the invention provides an expanding annular packer for use in the method for sealing of the annular space, comprising an expanding element consisting mainly of rubber material which is characterised in that the expanding element is directed to expanding mainly by absorbing hydrocarbons produced by the underground formation.

Further features of the invention are given in the claims 3-10.

SHORT DESCRIPTION OF THE FIGURES

Figure 1:
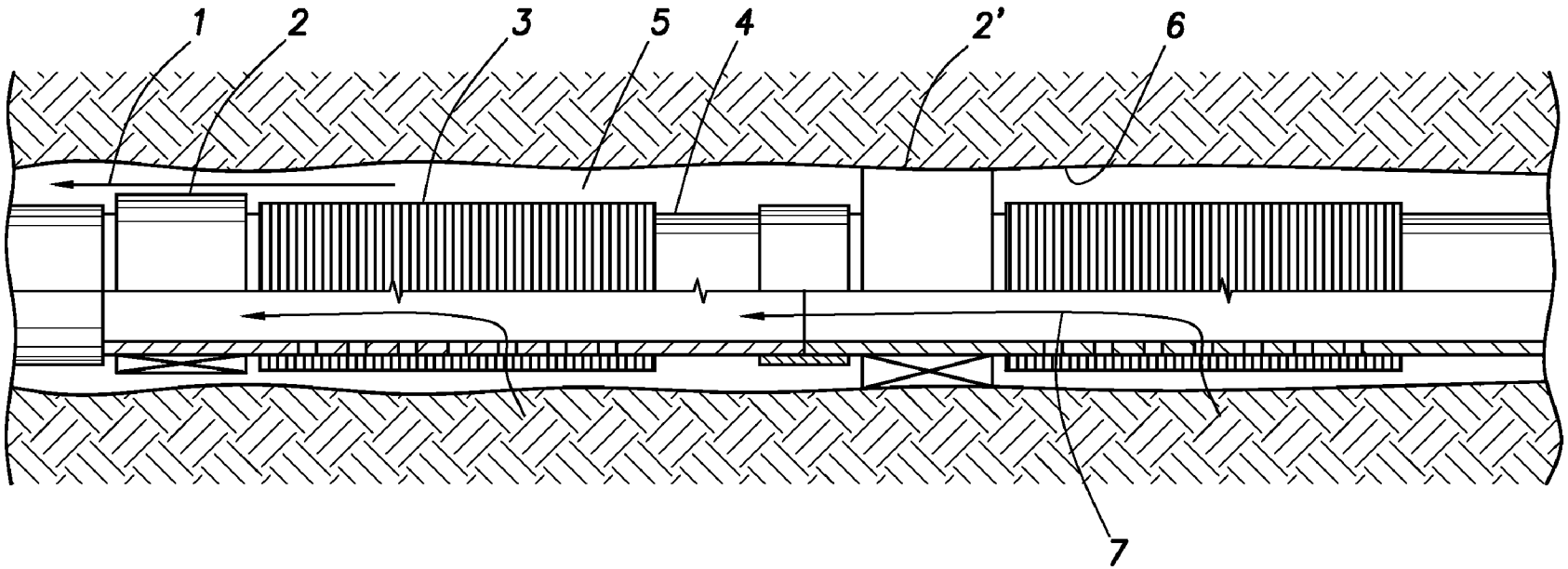
FIG. 1 is a longitudinal section through an area of a production well illustrating the present invention.
Figure 2:
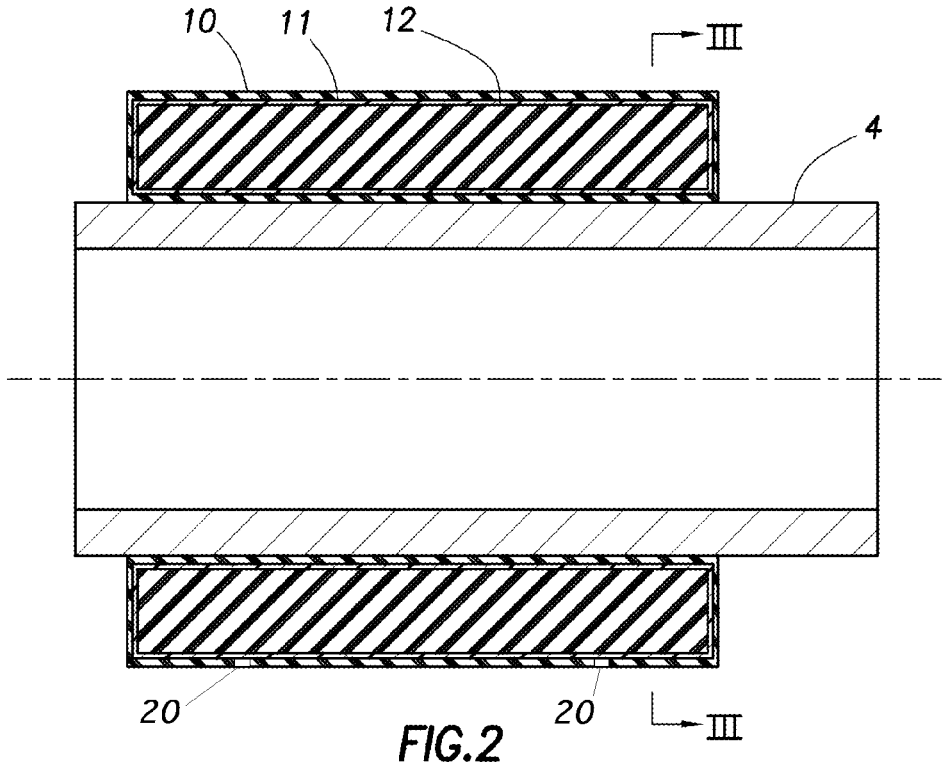
FIG. 2 is a longitudinal section of a production tubing with an annular packer according to the present invention.
Figure 3:
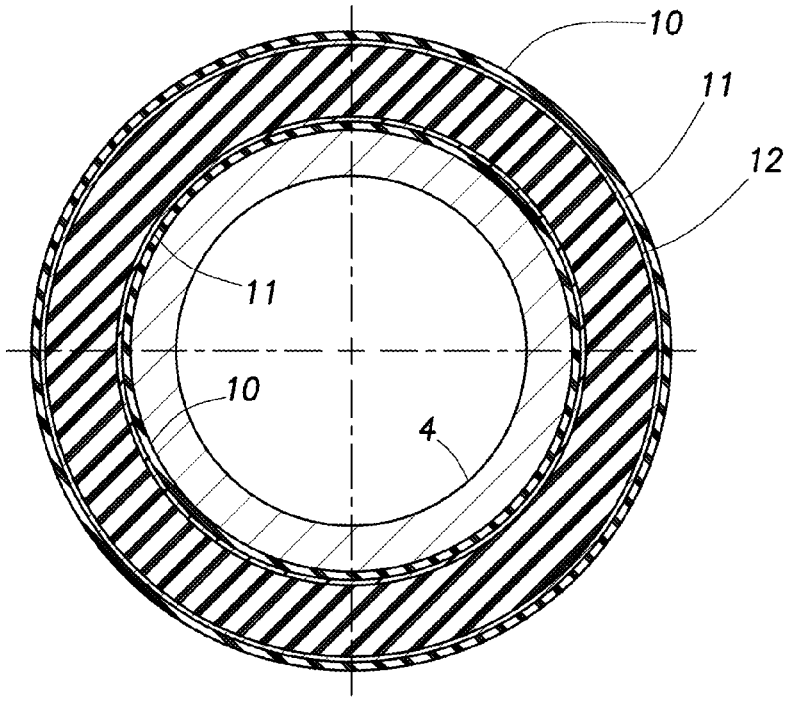
FIG. 3 is a section along the line III-III in FIG. 2.

In the following, the invention is further described. The permanent annular packer 2 for use in hydrocarbon production wells, preferably oil production wells, is placed on the outside of a pipe 4, said packer expands by the core 12 swelling upon exposure for and absorption of hydrocarbons. The packer therefore seals the annular space 5 towards the well wall 6. The production well may be an open-hole well or a well with a casing, which is characterised in that the production tubing 4 is drawn in an open hole or that the production tubing 4 is drawn in a casing (not shown), respectively. Thus the annular space 5 consists of the external surface of the production tubing 4 and the bore hole wall, or the external surface of the production tubing 4 and the internal surface in the casing, respectively.

An oil stream 1 flows past a packer element 2 before the packer element 2 is expanded and sealing towards the well wall 6. A sand control filter 3 is attached to a production tubing 4. A packer element 2' is expanded and sealing towards the well wall 6 so that a well fluid 7 can not bypass the packer element in the annular space 5.

An external, protecting mantle 10 equipped with a reinforcement 11 surrounds a core 12 comprising elastic polymer, said coating works as a permeable membrane. The external mantle 10 comprises a rubber with higher resistance and lower rate of diffusion towards hydrocarbons than the core 12. The packer element, which may consist of a mantle 10, reinforcement 11 and core 12, is placed on the outside of a tube 4.

The packer 2 consists of a core 12 comprising an elastic polymer, e.g. EPDM rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber or polynorbornene, said core is swelling in contact with and by absorption of hydrocarbons so that the packer expands. The rubber of the core may also have other materials dissolved or in mechanical mixture, such as fibres of cellulose processed as described in U.S. Pat. No. 4,240,800. Additional options may be rubber in mechanical mixture with polyvinyl chloride, methyl methacrylate, acrylonitrile, ethylacetate or other polymers expanding by contact with oil.

An external, reinforced mantle 10 protects the core towards direct exposure to drilling fluid and hydrocarbons. At the same time the mantle 10 allows migration of hydrocarbons to the core 12 and swelling (and thus expanding of the packer). The external, reinforced mantle 10 comprises rubber, for example acrylonitrile, hydrogenated nitrile, chloroprene, ethylene vinylacetate rubber, silicone, ethylene propylene diene monomer, butyl, chlorosulphonated polyethylene, polyurethane, ACM, BIMS or other types of rubber having less expansion or slower diffusion than the core and a reinforcement 11, preferably fibre reinforcement, e.g. kevlar, said reinforcement reinforces the external mantle 10. An essential feature of the rubber in the mantle 10 is that it has a swelling in drilling fluids, which is slower than the core 12. With "a higher resistance towards hydrocarbons" is here meant that the rubber only to a small degree swells upon exposure to hydrocarbons.

Several elastic polymers have a considerable absorption of hydrocarbons without absorption of water, and the polymers in the present invention are predominantly hydrophobic. By immersion in a hydrocarbonaceous medium, hydrocarbons migrate into and through the external mantle 10 and further into the core 12, which is swelling upon absorption of these.

The present invention provides several benefits compared to state of the art. The packer adjusts continuously to variations in the movements of the formation or washouts of the borehole, which implies that better shutting off/sealing between reservoir sections may be achieved and undesired well fluid can not flow past the packer element in the annular space. There is no need for well operations when installing the packer, which represents cost savings compared to today's methods for installation. The packer has no moving parts and is thus a simple and reliable device. The packer expands faster and more in a produced hydrocarbon, than in a water based or oil based drilling fluid or completion fluid at the same temperature and will thus expand less when the packer is immersed in drilling fluid.

In another embodiment of the present invention, the core 12 is surrounded by an external mantle of rubber, e.g. a nitrile which is not reinforced.

In further another embodiment of the present invention, the core 12 is surrounded by an outer web which may be the reinforcement.

In a further embodiment of the present invention the core 12 is surrounded by an external mantle of rubber, e.g. a nitrile, said mantle in itself does not let hydrocarbons penetrate, but a small part 11 of the core 12 is exposed directly to hydrocarbons through openings 20 in the outer coating.

In an even further embodiment of the present invention the core 12 is not surrounded by an external mantle, but is exposed directly to hydrocarbons. In this aspect, the core 12 has a composition comprising elastic polymer with sufficient features to fulfil the desired functions of the packers.

What is claimed is:

1. An apparatus for use in conjunction with a subterranean well, the apparatus comprising:

an expandable element including a core, and a membrane at least partially covering the core, the core including a first material which swells in response to contact with a hydrocarbon fluid, and the membrane including a second material which swells less than the first material swells in response to contact with the fluid.

2. The apparatus of claim 1, wherein the membrane is permeable to the fluid.

3. The apparatus of claim 1, wherein the membrane is impermeable to the fluid.

4. The apparatus of claim 1, wherein the membrane has at least one opening therein which permits contact between the first material and the fluid.

5. The apparatus of claim 1, further comprising a reinforcement material which reinforces the membrane.

6. The apparatus of claim 1, wherein the second material swells at a slower rate than the first material swells in response to contact with the fluid.

7. The apparatus of claim 1, wherein the fluid diffuses through the second material at a slower rate than the fluid diffuses through the first material.

8. An apparatus for use in conjunction with a subterranean well, the apparatus comprising:

an expandable element including a core, and a membrane at least partially covering the core, the core including a first material which swells in response to contact with a hydrocarbon fluid, and the membrane including a second material, wherein the hydrocarbon fluid diffuses through the membrane to contact the core, and wherein the fluid diffuses through the second material at a slower rate than the fluid diffuses through the first material.

9. The apparatus of claim 8, wherein the second material swells less than the first material swells in response to contact with the fluid.

10. The apparatus of claim 8, wherein the membrane is permeable to the fluid.

11. The apparatus of claim 8, wherein the membrane has at least one opening therein which permits contact between the first material and the fluid.

12. The apparatus of claim 8, further comprising a reinforcement material which reinforces the membrane.

13. The apparatus of claim 8, wherein the second material swells at a slower rate than the first material swells in response to contact with the fluid.

14. An apparatus for use in conjunction with a subterranean well, the apparatus comprising:

an expandable element including a core, and a membrane at least partially covering the core, the core including a first material which swells in response to contact with a selected fluid, and the membrane including a second material, wherein the membrane has at least one opening therein which permits contact between the first material and the fluid, and wherein the second material swells at a slower rate than the first material swells in response to contact with the fluid.

15. The apparatus of claim 14, wherein the second material swells less than the first material swells in response to contact with the fluid.

16. The apparatus of claim 14, wherein the membrane is permeable to the fluid.

17. The apparatus of claim 14, wherein the selected fluid includes hydrocarbon fluid.

18. The apparatus of claim 14, wherein the membrane is impermeable to the fluid.

19. The apparatus of claim 14, further comprising a reinforcement material which reinforces the membrane.

20. The apparatus of claim 14, wherein the fluid diffuses through the second material at a slower rate than the fluid diffuses through the first material.

* * * * *

UNITED STATES PATENT AND TRADEMARK OFFICE

CERTIFICATE OF CORRECTION

PATENT NO. : 7,472,757 B2
APPLICATION NO. : 11/551143
DATED : January 6, 2009
INVENTOR(S) : Jan Freyer It is certified that error appears in the above-identified patent and that said Letters Patent is hereby corrected as shown below:

After claim 20, add omitted claims 21-34

Col. 7 lines 1-12
--21. A method for sealing an annular space between a well wall in a production well for hydrocarbons and a production tubing, the method comprising the steps of:

applying at least one annular packer to the exterior of the production tubing, the packer including a first elastomer initially in an unexpanded state and adapted to swell to an expanded state when exposed to hydrocarbons, the packer having disposed externally to the first elastomer a second elastomer having properties of diffusing hydrocarbons therethrough and having a lower diffusion rate when exposed to hydrocarbons than the first elastomer;

inserting the production tubing into the well; and enabling hydrocarbons to enter the well, whereby the hydrocarbons in the well diffuse through the second elastomer and contact the first elastomer, which first elastomer swells from the unexpanded state to the expanded state upon exposure to and absorption of the hydrocarbons, thereby expanding the packer and sealing the annular space.--

Col. 7 lines 13-14
--22. The method of claim 21, wherein the second elastomer is adapted to swell when exposed to hydrocarbons.--

Col. 7 lines 15-16
--23. The method of claim 21, wherein a reinforcement is disposed between the first elastomer and the second elastomer on the packer.--

Col. 7 line 16
--24. The method of claim 23, wherein the reinforcement comprises fiber.--

Col. 7 lines 17-19
--25. The method of claim 21, wherein the second elastomer further comprises at least one of acrylonitrile, nitrile, hydrogenated nitrile, chloroprene, ethylene vinylacetate, silicone, ethylene propylene diene monomer, butyl, chlorosulphonated polyethylene, polyurethane, ACM and BIMS.--

UNITED STATES PATENT AND TRADEMARK OFFICE

CERTIFICATE OF CORRECTION

PATENT NO. : 7,472,757 B2
APPLICATION NO. : 11/551143
DATED : January 6, 2009
INVENTOR(S) : Jan Freyer It is certified that error appears in the above-identified patent and that said Letters Patent is hereby corrected as shown below:

(con't.)
Col. 7 lines 20-23
--26. The method of claim 21, wherein the first elastomer further comprises at least one of EPDM, styrene butadiene rubber, natural rubber, ethylene propylene monomer rubber, ethylene vinylacetate rubber, hydrogenated acrylonitrile butadiene rubber, acrylonitrile butadiene rubber, isoprene rubber, chloroprene rubber and polynorbornen.--

Col. 7 lines 24-26
--27. The method of claim 21, wherein the first elastomer includes at least one of processed fibers of cellulose and processed fibers of rubber, mechanically mixed with polymers expandable by contact with oil, the polymers comprising at least one of polyvinyl chloride, methyl methacrylate, acrylonitrile and ethylacetate.--

Col. 7 lines 27-35
--28. A packer for sealing an annular space between a well wall in a production well for hydrocarbons and a production tubing, the packer comprising:
a first elastomer initially in an unexpanded state adapted to swell when exposed to hydrocarbons in the well, the first elastomer formed generally in the shape of an annular cylinder applicable to the external surface of the production tubing,
wherein a second elastomer is applied to substantially the entire external surface of the first elastomer, the second elastomer having properties of diffusing hydrocarbons therethrough and having a lower diffusion rate when exposed to hydrocarbons than the first elastomer to delay swelling of the first elastomer from the unexpanded state to an expanded state in which the first elastomer and second elastomer seal the annular space.--

Col. 7 line 36
--29. The packer of claim 28, wherein the second elastomer is swellable.--

Col. 7 lines 37-38
--30. The packer of claim 28, wherein the packer further comprises a reinforcement disposed between the first elastomer and the second elastomer.--

Col. 7 line 39
--31. The packer of claim 30, wherein the reinforcement comprises fiber.--

UNITED STATES PATENT AND TRADEMARK OFFICE

CERTIFICATE OF CORRECTION

PATENT NO. : 7,472,757 B2
APPLICATION NO. : 11/551143
DATED : January 6, 2009
INVENTOR(S) : Jan Freyer It is certified that error appears in the above-identified patent and that said Letters Patent is hereby corrected as shown below:

(con't.)
Col. 7 lines 40-42
--32. The packer of claim 28, wherein the second elastomer comprises at least one of acrylonitrile, nitrile, hydrogenated nitrile, chloroprene, ethylene vinylacetate, silicone, ethylene propylene diene monomer, butyl, chlorosulphonated polyethylene, polyurethane, ACM, and BIMS.--

Col. 8 lines 1-4
--33. The packer of claim 28, wherein the first elastomer comprises at least one of EPDM, styrene butadiene rubber, natural rubber, ethylene propylene monomer rubber, ethylene vinylacetate rubber, hydrogenated acrylonitrile butadiene rubber, acrylonitrile butadiene rubber, isoprene rubber, chloroprene rubber and polynorbornen.--

Col. 8 lines 5-8
--34. The packer of claim 28, wherein the first elastomer includes at least one of processed fibers of cellulose and processed fibers of rubber, the processed fibers mechanically mixed with polymers expandable by contact with oil, the polymers comprising at least one of polyvinyl chloride, methylmethacrylate, acrylonitrile and ethylacetate.--

Signed and Sealed this

Seventh Day of July, 2009

John Doll

JOHN DOLL
*Acting Director of the United States Patent and Trademark Office*